US006691614B2

(12) United States Patent
Bell et al.

(10) Patent No.: US 6,691,614 B2
(45) Date of Patent: Feb. 17, 2004

(54) MULTI-LAYERED PRINTING SLEEVE

(75) Inventors: Michael Bell, Sugar Hill, GA (US); Felice Rossini, Milan (IT)

(73) Assignee: Rossini North America, Inc., Buford, GA (US)

( * ) Notice: Subject to any disclaimer, the term of this patent is extended or adjusted under 35 U.S.C. 154(b) by 0 days.

(21) Appl. No.: 09/883,086

(22) Filed: Jun. 15, 2001

(65) Prior Publication Data

US 2002/0046668 A1 Apr. 25, 2002

Related U.S. Application Data

(60) Provisional application No. 60/212,137, filed on Jun. 16, 2000.

(51) Int. Cl.[7] ..... B41F 13/16

(52) U.S. Cl. ..... 101/376; 101/375; 101/401.1; 428/909

(58) Field of Search ..... 101/375, 376, 101/217, 477, 153, 401.1; 428/909

(56) References Cited

U.S. PATENT DOCUMENTS

| | | | | | |
|---|---|---|---|---|---|
| 5,131,325 | A | * | 7/1992 | Blauvelt | 101/375 |
| 5,216,954 | A | * | 6/1993 | Thompson | 101/375 |
| 5,507,228 | A | * | 4/1996 | Schulz | 101/375 |
| 5,832,824 | A | * | 11/1998 | Okubo et al. | 101/217 |
| 6,161,478 | A | * | 12/2000 | Katz | 101/368 |
| 6,276,271 | B1 | * | 8/2001 | Busshoff | 101/375 |
| 6,401,613 | B1 | * | 6/2002 | Gayle et al. | 101/375 |

* cited by examiner

*Primary Examiner*—Andrew H. Hirshfeld
*Assistant Examiner*—Dave A. Ghatt
(74) *Attorney, Agent, or Firm*—Dority & Manning, P.A.

(57) ABSTRACT

A printing sleeve for use in flexographic or gravure printing applications is provided. In particular, the printing sleeve contains a bridge layer that is formed from a generally rigid and relatively expandable material, which is disposed adjacent to a core layer. For example, in one embodiment, the bridge layer is made from a polyurethane material having a Shore D hardness of about 20 to about 85. As a result of the present invention, printing sleeves can be formed to be more durable and maintain better TIR tolerances than conventional printing sleeves.

34 Claims, 5 Drawing Sheets

MULTI-LAYERED PRINTING SLEEVE

RELATED APPLICATIONS

The present application is based upon a provisional application filed on Jun. 16, 2000 having U.S. Serial No. 60/212,137.

BACKGROUND OF THE INVENTION

Printing sleeves are commonly used in a variety of applications, including flexographic and gravure printing. In particular, a printing sleeve that is generally cylindrical in shape can be mounted onto a rotatable printing cylinder for printing images onto a substrate.

A variety of mechanisms can be used to mount the printing sleeve onto the printing cylinder. For instance, "air-mounting" is one common way of mounting a printing sleeve. Air-mounting generally refers to the placement of a printing sleeve onto a printing cylinder by supplying pressurized air between the sleeve and the cylinder. Typically, the printing sleeve has an inner surface diameter that is slightly smaller than the outer surface diameter of the printing cylinder. The difference in these diameters is a dimension known as the "interference fit". Thus, by applying pressurized air, the diameter of the printing sleeve can be slightly expanded so that the sleeve can be mounted onto and/or removed from a printing cylinder.

In some instances, an air-mountable printing sleeve can be formed from multiple concentric layers. In particular, most printing jobs involve an "image repeat", which is the circumferential length of the image that is to be printed one or more times on a substrate. The circumference of a printing sleeve must be large enough to contain one or more image repeats. Moreover, different printing jobs may involve image repeats that differ in size, and consequently, different printing jobs may require printing sleeve repeats that also differ in size. For instance, a larger sleeve repeat size requires a printing sleeve with a larger circumferences or outer diameter for the same printing cylinder diameter.

To perform a job that requires a larger sleeve repeat size, the outer surface diameter of the printing sleeve must be large enough to yield the larger sleeve repeat size. Thus, printing sleeves resulting from multiple layers are generally used to provide the necessary radial thickness. Specifically, the multi-layer printing sleeves have the effect of increasing the outer diameter of the sleeve to provide a larger repeat size so that the sleeve can be mounted on a smaller diameter printing cylinder that is already available in inventory.

For example, one type of multi-layered sleeve that is currently used in the art includes an innermost core layer that is formed from wound fiberglass coated with epoxy resin. One version of this sleeve contains a bridge layer made from polyurethane (e.g., ISA-PUR 2340) disposed on the outer surface of a core layer. However, this sleeve is generally not capable of being air-mounted onto a cylinder at standard operating pressures (e.g., 80 to 90 psi) unless the thickness of the printing sleeve is less than 0.250 inches. In particular, it was believed that a compressible layer was required to form such air-mountable, multi-layered printing sleeves with a thickness greater than 0.250 inches.

For example, sleeves having a thickness greater than 0.250 inches contain a compressible layer with elastic properties for absorbing radial expansion of the core. The compressible layer is disposed on the outer surface of the core layer and is typically formed from open cell urethanes (e.g., a polyether/polyester polyurethane foam sold as Scotch-Mount™ 4032 by Minnesota Mining and Manufacturing Company) or a rubber material. In general, the compressible layer usually has a thickness between 0.0030 to 0.250 inches.

In addition to the above layers, the prior art multi-layered sleeve also contains one or more layers that add thickness to the sleeve. For example, materials such as rigid polyurethane foam or other forms of polyurethane (e.g., ISA-PUR 2330 and ISA-PUR 2340 which are sold by H.B. Fuller Austria, NOMEX® which is sold by DUPONT, and honeycomb structures) are utilized by the prior art sleeve. The thickness of such layers varies depending on the particular image repeat utilized, but is typically less than 3 inches. In addition, other outer layers are also sometimes disposed on the outer surface of these layers.

However, one problem associated with such multi-layered printing sleeves is that the compressible layer of the sleeves tends to disintegrate after a period of time. Specifically, as the sleeve is used to impart an image onto a substrate for a period of about 1 to 2 years, the open cell structure of a polyether polyurethane foam layer, for example, gradually becomes destroyed. As a result, the tolerance (or roundness) of the outermost surface of the sleeve decreases. In particular, the "Total Indicated Runout" (TIR) often increases to greater than 0.001 inches, which causes the sleeve to be ill-suited for most printing applications. Thus, when the compressible layer is destroyed, current sleeve users or "converters" must replace these damaged sleeves with new and expensive sleeves.

As such, a need currently exists for an improved multi-layered printing sleeve that is capable of being air-mounted onto a printing cylinder.

SUMMARY OF THE INVENTION

The present invention is generally directed to a printing sleeve for use in flexographic or gravure printing applications. In particular, a printing sleeve of the present invention contains a bridge layer that is formed from a generally rigid and relatively expandable material, which is disposed adjacent to a core layer.

In general, the printing sleeve includes a core layer that is generally cylindrical in shape and that constitutes the innermost portion of the printing sleeve. In some embodiments, the core layer of the printing sleeve is formed of an expandable, high rigidity material. Some examples of compositions that are suitable for use in the core layer include, but are not limited to, aramid fiber bonded with epoxy resin or polyester resin; reinforced polymeric material such as hardened glass fiber bonded with epoxy resin or polyester resin, the latter two also known as fiberglass reinforced epoxy resin or fiberglass reinforced polyester; DUPONT® MYLAR® or tri-laminate KEVLAR®; carbon-reinforced epoxy resin; nickel; copper; and the like. The radial thickness of the core layer can, in some embodiments, be between about 0.020 to about 0.100 inches, with the larger thickness being used for sleeves with greater diameters and/or axial lengths.

As stated, a printing sleeve of the present invention also includes a generally cylindrical bridge layer. The bridge layer can be made from a generally rigid, relatively expandable material. As used herein, the phrase "rigid" refers to a material having a certain Shore hardness. In some embodiments, for example, the bridge layer can be made from a material having a Shore D hardness of about 20 to about 85, and in some embodiments, from about 45 to about 50. In one particular embodiment, for example, the bridge layer can contain a polyurethane material having a Shore D hardness between about 45 to about 50. One such polyurethane material may be obtained from H.B. Fuller Austria under the tradename ISA-PUR 2330.

Besides being generally rigid, the bridge layer, as stated above, can also be relatively expandable. As used herein, the term "expandable" refers to a material that can expand a certain radial distance upon the application of air at a certain pressure. For example, at air pressures between about 80 to about 90 psi, the printing sleeves typically expand in a radial direction between about 0.0015 to about 0.0045 inches, and in some embodiments, between about 0.0025 to about 0.0035 inches. For example, in one embodiment, a printing sleeve having a diameter less than 7 inches expands, in a radial direction, about 0.0025 inches. Moreover, in another embodiment, a printing sleeve having an inner diameter greater than 7 inches expands, in a radial direction, about 0.0035 inches.

The thickness of the bridge layer can generally vary. In most embodiments, for example, the thickness of the bridge layer is between about 0.125 to about 1.50 inches, and in some embodiments, between about 0.125 inches to about 1.00 inches.

Moreover, the printing sleeve can also contain one or more outer layers disposed on the outer surface of the bridge layer. The outer layer(s) can be used to add further thickness to the sleeve and/or as a cover layer for the sleeve. In general, any number, size, shape, and/or type of outer layers can be used in the present invention, so long as the resulting printing sleeve can be air-mounted onto a printing cylinder. For example, some suitable materials that can be utilized in forming an outer layer include, but are not limited to, aramid fiber bonded with epoxy resin or polyester resin; reinforced polymeric material such as hardened glass fiber bonded with epoxy resin or polyester resin, the latter two also known as fiberglass reinforced epoxy resin or fiberglass reinforced polyester; DUPONT® MYLAR® or tri-laminate KEVLAR®; a polyurethane material (e.g., ISA-PUR 2330 or ISA-PUR 2340 from H.B. Fuller Austria under the tradename ISA-PUR 2330); elastomeric rubber materials; elastomeric polyurethane materials; polyurethane expanded foam; open cell polyurethane foam; nickel; copper; carbon-reinforced epoxy resin; and the like. In some embodiments, a metal outer layer, such as an aluminum extruded layer, can also be pressed onto the bridge layer.

Further, the outer layer(s) can also be made from a rigid material or non-rigid material. For instance, in one embodiment, an outer layer can be made from a polyurethane material having a Shore D hardness from about 75 to about 85. In addition, the outer layer(s) can also have any desired thickness, so long as the overall thickness of the printing sleeve is greater than about 0.250 inches. For example, in one embodiment, an outer layer has a thickness greater than about 0.050 inches, in some embodiments between about 0.065 to about 0.250 inches, and in some embodiments, between about 0.075 to about 0.200 inches.

As a result of the present invention, printing sleeves can be formed without a compressible layer disposed adjacent to the outer surface of a core layer. By eliminating such a compressible layer, the printing sleeves of the present invention are believed to be more durable and maintain better TIR tolerances than conventional printing sleeves. In particular, a generally rigid bridge layer that can expand during mounting and demounting can provide the printing sleeve with durable properties.

Other features and aspects of the present invention are discussed in greater detail below.

Repeat use of references characters in the present specification and drawings is intended to represent same or analogous features or elements of the invention.

DETAILED DESCRIPTION OF REPRESENTATIVE EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations and their equivalents.

In general, the present invention is directed to an improved printing sleeve for use in flexographic or gravure printing. In particular, the present invention is directed to a durable, multi-layered printing sleeve that is capable of expanding, for example, between about 0.0025 to about 0.0035 inches without the use of a compressible layer. For example, in one embodiment of the present invention, the printing sleeve has a thickness greater than about 0.250 inches and includes a generally rigid, relatively expandable bridge layer disposed adjacent to a core layer.

Referring to FIGS. 1, 2A–2C, 3A–3C, & 4A–4C, one embodiment of a printing sleeve of the present invention is illustrated. The printing sleeve is generally cylindrical and can have parallel or tapered cores depending on the different types of printing cylinders available (parallel or tapered).

Figure 1:
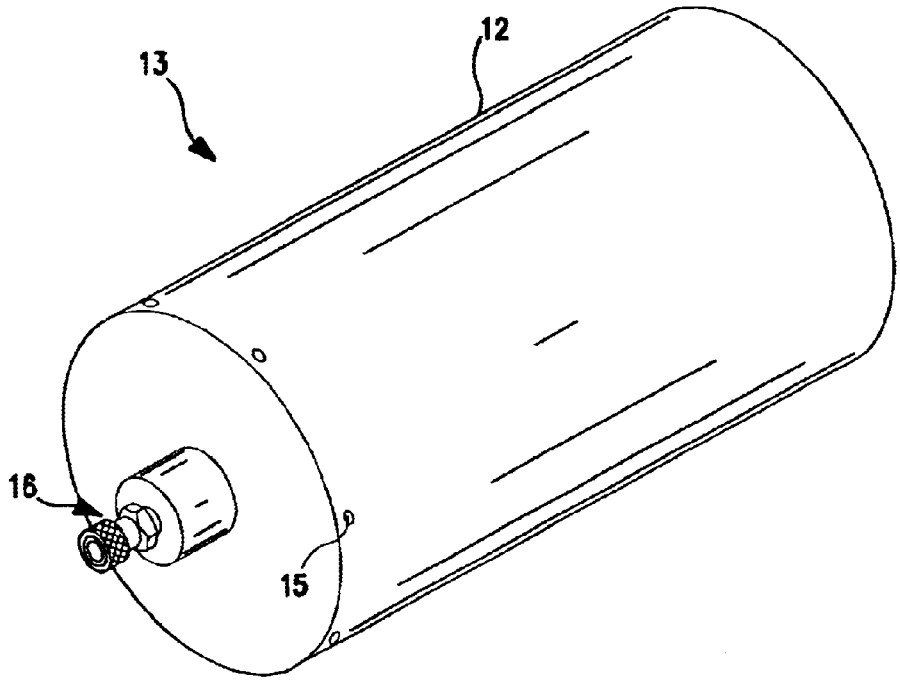
FIG. 1 is an elevated perspective view of an example of a printing cylinder that can be air-mounted with one embodiment of a printing sleeve of the present invention.
Figure 2A:
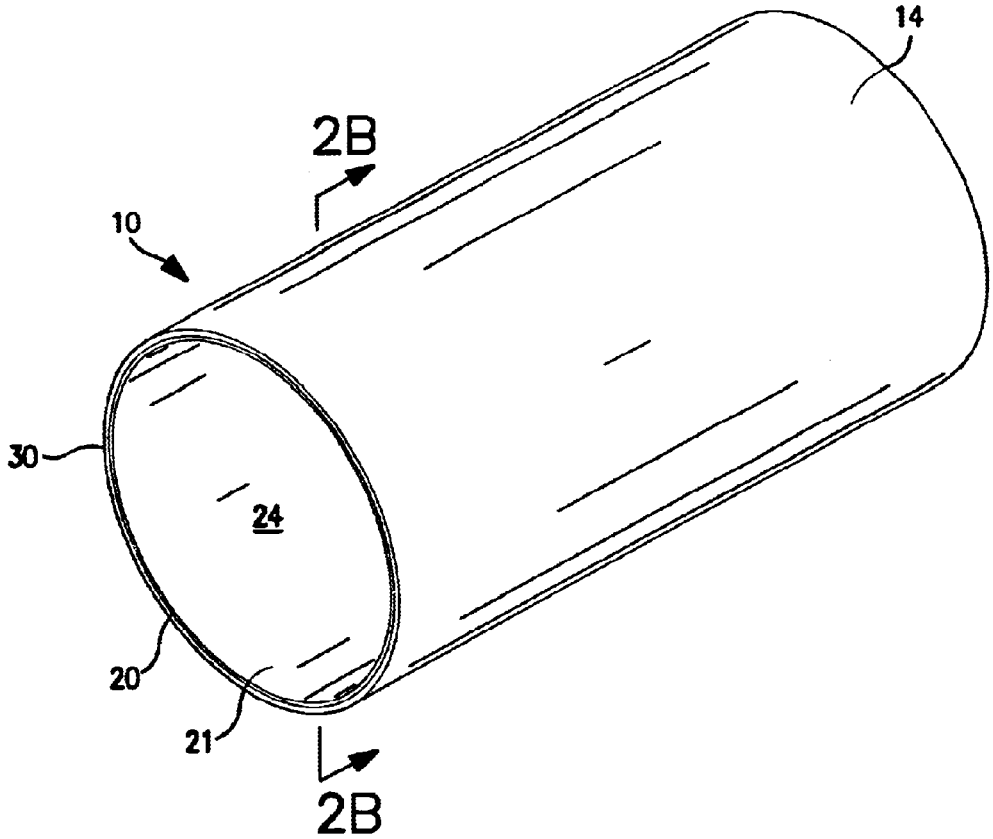
FIG. 2A is an elevated perspective view of a printing sleeve made in accordance with one embodiment of the present invention.

As shown in FIGS. 1 & 2A, for example, a generally cylindrical printing sleeve 10 is provided that can be mounted onto the outer surface 12 of a printing cylinder 13.

As is typical, the printing sleeve 10 has a smaller inside diameter than the exterior diameter of the printing cylinder 13. Moreover, in this embodiment, the printing cylinder 13 has holes 15 disposed around the circumference of one end of the printing cylinder that are capable of providing pressurized air through a valve 16 from an air source (not shown). Although any pressure can be provided, pressures greater than about 65 pounds per square inch (psi), and more particularly between about 80 to about 90 psi, are typically utilized.

By providing pressurized air, the diameter of the printing sleeve 10 can be slightly increased so as to be capable of fitting onto the outer surface 12 of the printing cylinder 13. Specifically, to mount the printing sleeve 10 onto the cylinder 13, a user can simply position it onto the cylinder 13 as pressurized air is simultaneously supplied. Once positioned onto the cylinder 13, the pressurized air can then be released, thereby resulting in the printing sleeve 10 being tightly retained on the printing cylinder 13. To utilize the printing sleeve 10, a printing plate (not shown), which defines the image to be printed on the substrate (not shown), can then be attached to the outer surface 14 of the printing sleeve 10.

Figure 2B:
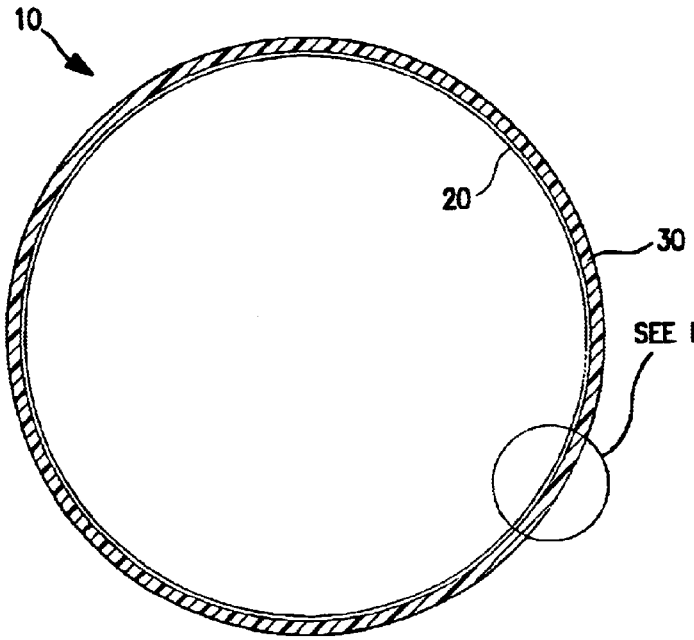
FIG. 2B is a cross-sectional view taken along the line of sight designated by the numerals 2B—2B in FIG. 2A.
Figure 2C:
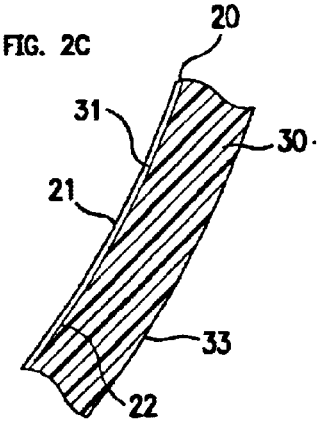
FIG. 2C is an enlarged sectional view of the printing sleeve illustrated in FIG. 2B.

Illustrative embodiments of a printing sleeve of the present invention are depicted in more detail in FIGS. 2A–2C, 3A–3C, and 4A–4C. For instance, as shown in FIGS. 2A–2C, the printing sleeve 10 includes a core layer 20 having a generally cylindrical shape that constitutes the innermost portion of the printing sleeve. As shown, the core layer 20 can have a cylindrical inner surface 21 and a cylindrical outer surface 22 that is generally concentric with inner surface 21. The cylindrical inner surface 21 of the core layer 20 thus defines a hollow internal region 24 of the printing sleeve 10, which can allow the inner surface 21 of the core layer 20 to be positioned onto the outer surface 12 of the printing cylinder 13.

In general, any of a variety of materials used in forming printing sleeves can be utilized to form the core layer 20. In some embodiments, the core layer 20 is formed of an expandable, high rigidity material. Such materials are expandable so that core layer 20 can be repeatedly expanded and contracted without adverse consequences in order to form an interference fit with the outer surface of a printing cylinder. The degree of permitted expansion and contraction need not be so large as to be detectable by the naked eye.

Some examples of compositions that are suitable for composing the core layer 20 include, but are not limited to, aramid fiber bonded with epoxy resin or polyester resin; reinforced polymeric material such as hardened glass fiber bonded with epoxy resin or polyester resin, the latter two also known as fiberglass reinforced epoxy resin or fiberglass reinforced polyester; DUPONT® MYLAR® or tri-laminate KEVLAR® that may optionally be reinforced with a resin, such as epoxy resin or polyester resin; nickel; copper; carbon-reinforced epoxy resin; and the like. Moreover, the core layer 20 can also be made in a manner similar to the printing sleeves in U.S. Pat. No. 4,144,812 to Julian or U.S. Pat. No. 4,903,597 to Hoage, et al., which are incorporated herein in their entirety by reference thereto for all purposes. The radial thickness of the core layer 20 can also vary, depending on the desired application. For instance, in some embodiments, the core layer 20 can have a thickness between about 0.020 to about 0.100 inches, with the larger a thickness being used for sleeves with greater diameters and/or axial length. For example, in one particular embodiment, the core layer 20 is made from wound fiberglass that is coated with epoxy resin having a thickness of 0.040 inches.

The printing sleeve 10 can also include a bridge layer having a generally cylindrical shape. In the past, layers were utilized to provide a printing sleeve with an increased thickness for large image repeats. It was thought, however, that a non-rigid, compressible layer (e.g., rubber or polyester/polyether polyurethane foam) was required for sleeves having a thickness greater than about 0.250 inches. In particular, a compressible layer having a Shore A hardness of about 25–30, for example, was disposed between the core member and one or more layers to allow the core member to expand.

The inventors of the present invention, however, have discovered that a generally rigid, relatively expandable bridge layer can be utilized to increase the thickness of a printing sleeve, as well as to allow the core member to adequately expand for mounting and demounting the sleeve onto a printing cylinder. Moreover, it has also been unexpectedly discovered that such expansion can be accomplished without the use of a non-rigid, compressible layer.

In this regard, as shown in FIGS. 2A–2C, a cylindrical inner surface 31 of a bridge layer 30 can be disposed on the outer surface 22 of the core layer 20. The bridge layer 30 also includes a cylindrical outer surface 33 that is generally concentric with the inner surface 31. In most embodiments, the bridge layer 30 is made from any material that is generally rigid. As used herein, the phrase "rigid" refers to a material having a certain Shore hardness. In some embodiments, for example, the bridge layer 30 can be made from a material having a Shore D hardness of about 20 to about 85, and particularly from about 45 to about 50. However, it should be understood that the hardness values given above are only some examples of materials with suitable rigidity. In particular, the required hardness can be lower or higher than the values indicated above, depending on a variety of factors, such as the thickness of sleeve and/or bridge layer, the diameter of sleeve and/or bridge layer, the axial length of sleeve and/or bridge layer, the amount of air pressure applied to mount or demount the sleeve, the interference fit utilized, etc. For instance, a more rigid material can be utilized for the bridge layer when applying higher air pressures during mounting or demounting.

Besides being generally rigid, the bridge layer 30 is also relatively expandable. As used herein, the term "expandable" refers to a material that can expand a certain radial distance upon the application of air at a certain pressure. For example, at pressures between about 80 to about 90 psi, the printing sleeve 10 can typically expand in a radial direction between about 0.0015 to about 0.0045 inches, and more particularly between about 0.0025 to about 0.0035 inches. However, the required amount of expansion for the sleeve 10 can generally vary depending on a variety of factors, such as the diameter of the sleeve, the interference fit utilized, the axial length of the sleeve, etc. For example, in one embodiment, a printing sleeve having a diameter less than 7 inches expands about 0.0025 inches in a radial direction. Moreover, in another embodiment, a printing sleeve having a diameter greater than 7 inches expands about 0.0035 inches in a radial direction.

In general, the thickness of the bridge layer 30 can also vary. In particular, the thickness utilized can vary depending on a variety of factors, such as the hardness of the material, the diameter of sleeve and/or bridge layer, the axial length of sleeve and/or bridge layer, the amount of air pressure applied to mount or demount the sleeve, the interference fit utilized, etc. For example, the thickness of the bridge layer can be up to about 0.250 inches. In most embodiments, however, the thickness of the bridge layer 30 is between about 0.125 to about 1.50 inches, and particularly between about 0.125 to about 1.00 inches.

For example, in one particular embodiment, as shown in FIGS. 2A–2C, a polyurethane material having a Shore D hardness between about 45 to about 50 can be utilized to form the bridge layer 30. One such polyurethane material may be obtained from H.B. Fuller Austria under the tradename ISA-PUR 2330. If desired, other materials can also be used in conjunction with the polyurethane material to form the bridge layer 30. For example, a hardener and/or a thixotrope can be combined with the polyurethane material to aid in forming the layer 30 onto the outer surface 22 of the core layer 20. Such materials may also be obtained from H.B. Fuller Austria.

Figure 3A:
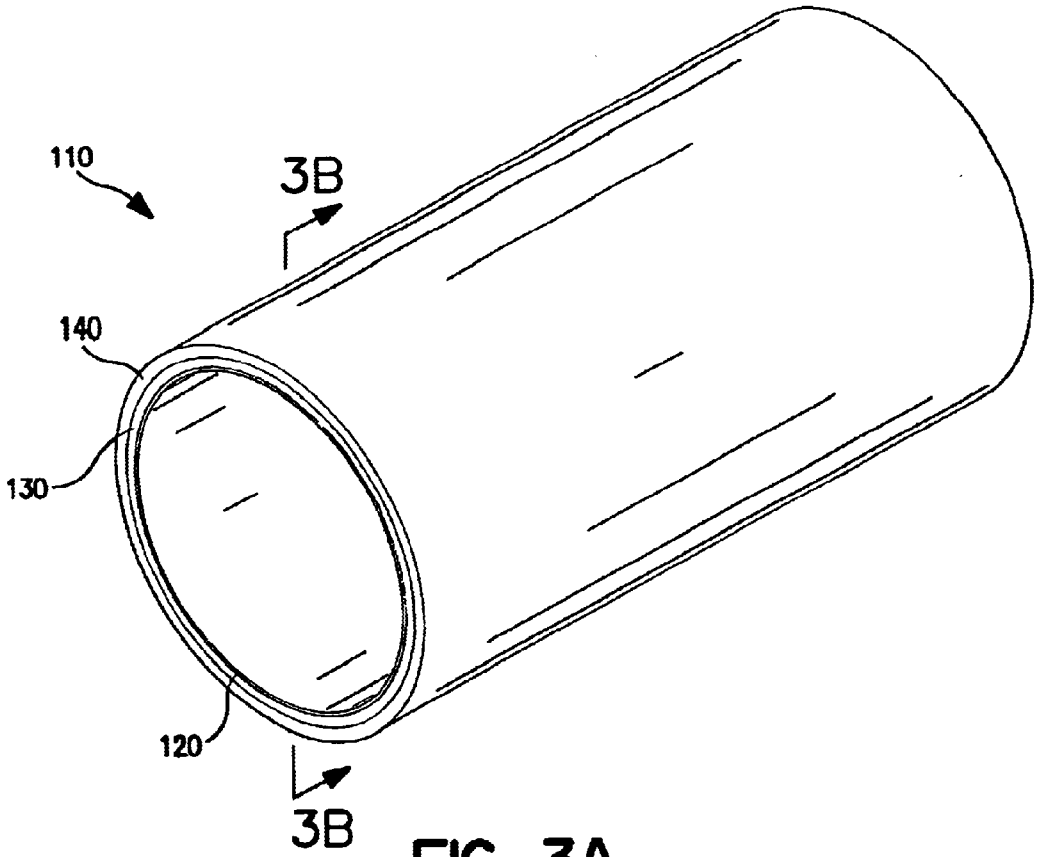
FIG. 3A is an elevated perspective view of a printing sleeve made in accordance with one embodiment of the present invention.
Figure 3B:
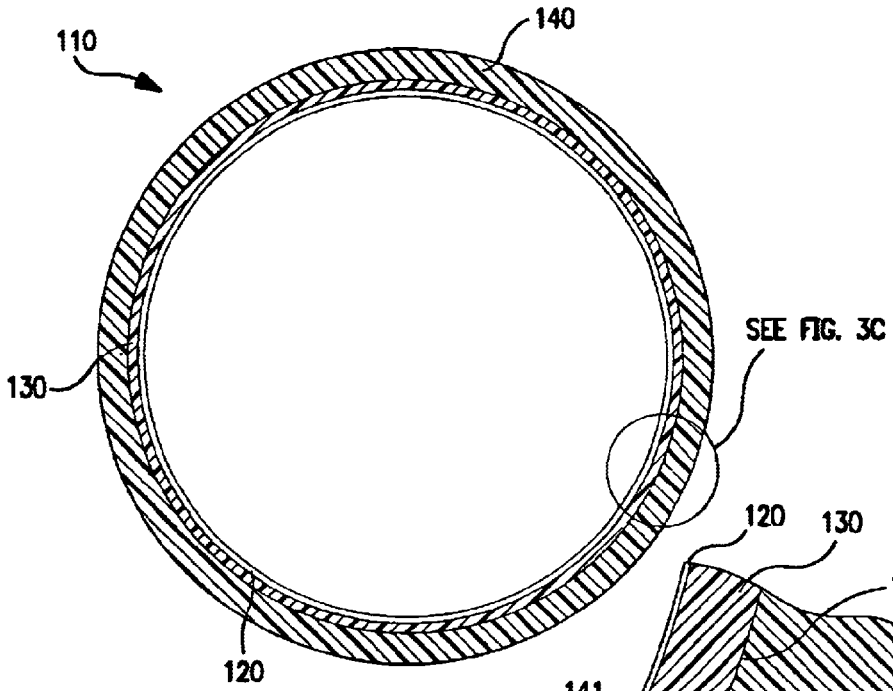
FIG. 3B is a cross-sectional view taken along the line of sight designated by the numerals 3B—3B in FIG. 3A.
Figure 3C:
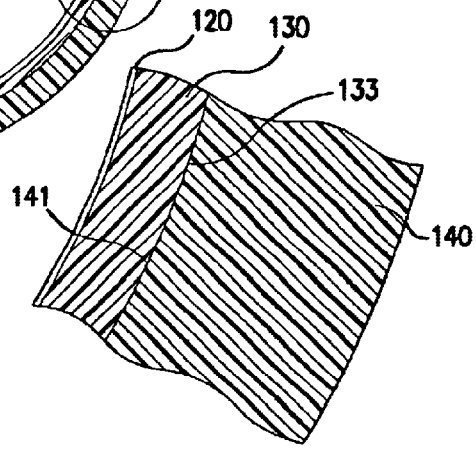
FIG. 3C is an enlarged sectional view of the printing sleeve illustrated in FIG. 3B.
Figure 4A:
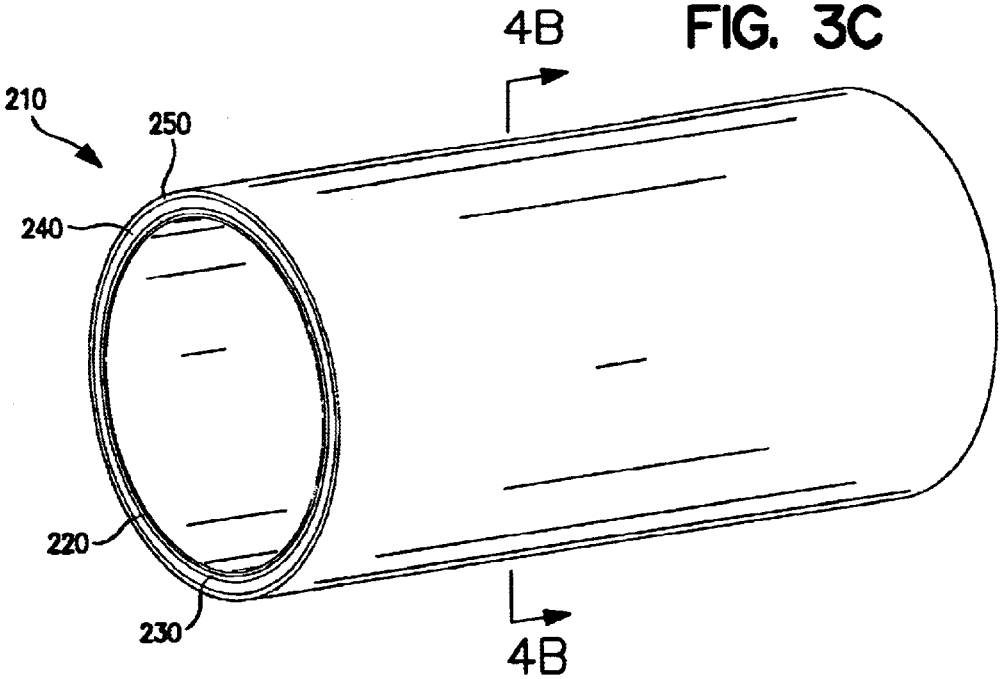
FIG. 4A is an elevated perspective view of a printing sleeve made in accordance with one embodiment of the present invention.
Figure 4B:
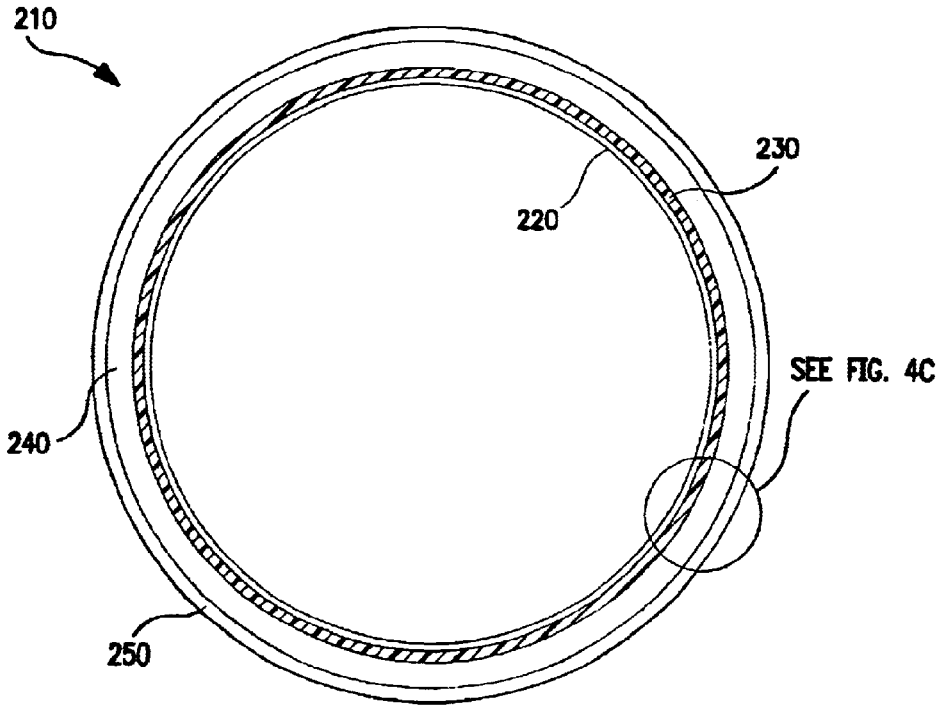
FIG. 4B is a cross-sectional view taken along the line of sight designated by the numerals 4B—4B in FIG. 4A.
Figure 4C:
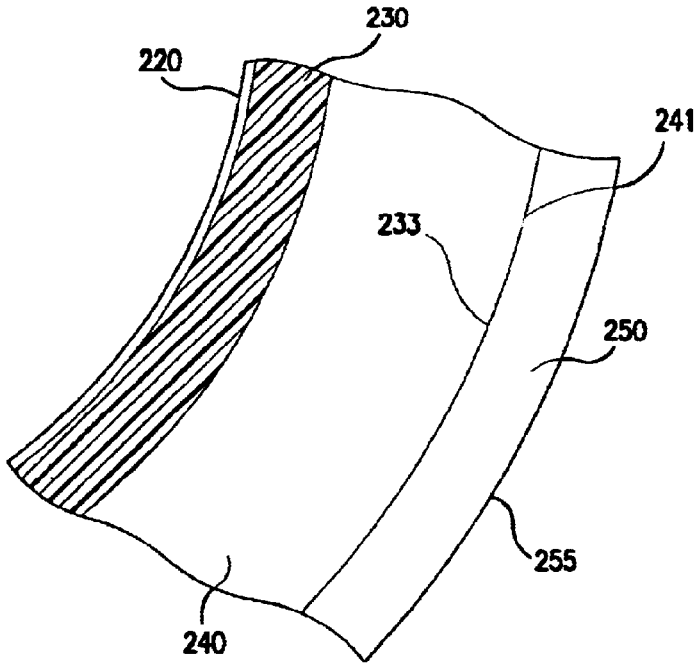
FIG. 4C is an enlarged sectional view of the printing sleeve illustrated in FIG. 4B.

Referring to FIGS. 3A–3C & 4A–4C, the sleeve 10 can also contain one or more outer layers in addition to the core and bridge layers. The outer layer(s) can be used to add further thickness to the sleeve or as a cover layer for the sleeve. For example, as shown in FIGS. 3A–3C, a sleeve 110 can contain a core layer 120, a bridge layer 130, and a generally cylindrical outer layer 140. The inner surface 141 of the outer layer 140 can be disposed on the outer surface 133 of the bridge layer 130. In another embodiment, as shown in FIGS. 4A–4C, a sleeve 210 contains a core layer 220, a bridge layer 230, a first outer layer 240, and a second generally cylindrical outer layer 250. As illustrated, the inner surface 233 of the outer layer 250 is disposed on the outer surface 241 of the outer layer 240.

In general, the outer layer(s) can be made from any of a variety of materials. For example, some suitable materials that can be utilized in forming an outer layer include, but are not limited to, aramid fiber bonded with epoxy resin or polyester resin; reinforced polymeric material such as hardened glass fiber bonded with epoxy resin or polyester resin, the latter two also known as fiberglass reinforced epoxy resin or fiberglass reinforced polyester; DUPONT® MYLAR® or tri-laminate KEVLAR®; a polyurethane material (e.g., ISA-PUR 2330 or ISA-PUR 2340 from H.B. Fuller Austria under the tradename ISA-PUR 2330); elastomeric rubber materials; elastomeric polyurethane materials; polyurethane expanded foam; open cell polyurethane foam; nickel; copper; carbon-reinforced epoxy resin; and the like. In some embodiments, a metal outer layer, such as an aluminum extruded layer, can also be pressed onto the bridge layer.

Moreover, the outer layer(s) can also be made from a rigid material or non-rigid material. For example, as shown in FIGS. 3A–3C, the outer layer 140 can be a generally rigid material having a hardness greater than the hardness of the bridge layer 130. For instance, in one embodiment, the outer layer 140 is made from a polyurethane material having a Shore D hardness from about 75 to about 85. One example of such a polyurethane material is sold by H.B. Fuller Austria under the tradename of ISA-PUR 2340.

In general, the outer layer(s) can also have any desired thickness, so long as the overall thickness of the resulting printing sleeve is greater than about 0.250 inches. For example, in one embodiment, as shown in FIGS. 3A–3C, the outer layer 140 is made from ISA-PUR 2340, a hardener, and a thixotrope so that the resulting layer 140 has a thickness greater than about 0.050 inches, in some embodiments between about 0.065 to about 0.250 inches, and in some embodiments, between about 0.075 to about 0.200 inches.

The outermost surface of the printing sleeve, e.g., an outer surface 255 of outer layer 250, can also be provided with a smooth finish to a tolerance capable of supporting a printing plate thereon. In fact, the outer surface 250 is normally round and smooth enough so that the combined Total Indicated Runout (TIR) of the printing sleeve, which can be determined according to techniques that are well known in the art, is less than about 0.001 inches. Moreover, if desired, the outer surfaces of other layers, such as the bridge layers 30, 130, 230 or the outer layers 140 or 240, can also be provided with a smooth finish.

The printing sleeves of the present invention may also be formed with additional features. For example, printing cylinders are commonly provided with a register pin to facilitate repeatable orientation of the printing sleeve thereon via a keyway or slot formed in the sleeve. For such printing cylinders, the printing sleeve of the present invention can be provided with a similar keyway or slot for adapting to such printing cylinders and/or a similar pin for adapting such printing sleeves.

In addition, printing sleeves of the present invention can also be provided with various other features, such as gas passageways, spacer rings, etc. For example, when incorporated with gas passageways, a printing sleeve of the present invention can also be used as a "spacer sleeve" to act as a spacer between the printing cylinder and another printing sleeve mounted with a printing plate. As described in U.S. Pat. No. 5,819,657 to Rossini, which is incorporated herein in its entirety by reference thereto for all purposes, a "spacer sleeve" can enable a converter to use a single sleeve to accommodate almost any printing sleeve.

One embodiment of a printing sleeve of the present invention that includes one or more gas passageways will now be described in more detail. It should be understood, however, that the description below is merely one embodiment for providing the sleeve with one or more gas passageways, and that other embodiments and features are also contemplated by the present invention, such as described in U.S. Pat. No. 5,819,657 to Rossini.

Figure 5:
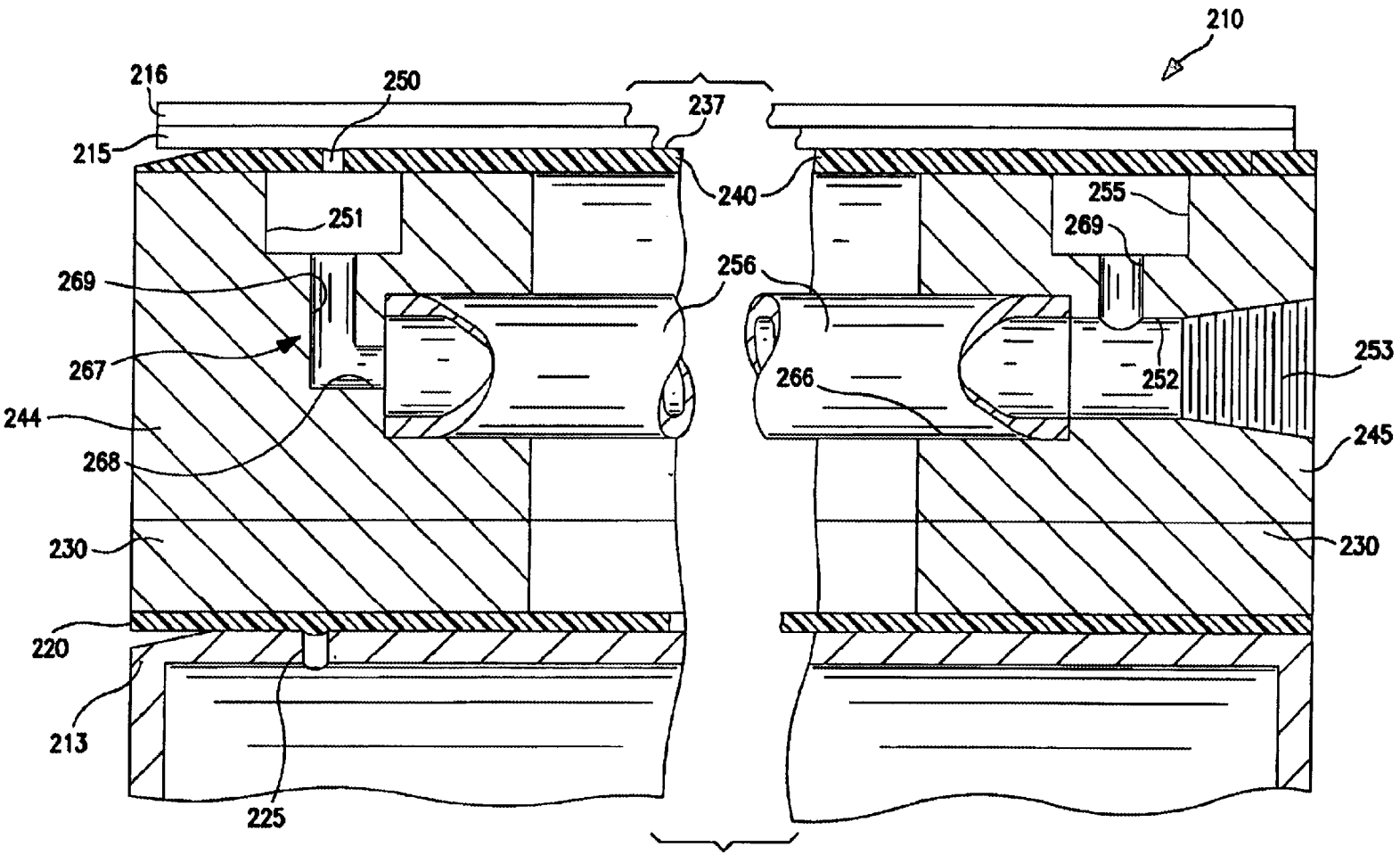
FIG. 5 is a partial cross-sectional view of embodiment of the printing sleeve of the present invention mounted on a printing cylinder.

In this regard, referring to FIG. 5, one embodiment of the present invention is illustrated in which the printing sleeve described above is utilized as a spacer sleeve. As shown, the sleeve 210 includes a core layer 220, a bridge layer 230, and a generally cylindrical outer layer 240. As stated above, the sleeve 210 is also provided with one or more gas passageways so that a gas can be provided through the sleeve to assist in the mounting of other printing sleeves. For instance, as shown in FIG. 5, the sleeve 210 includes at least one channel 250 that is formed through the outer surface 237 of the outer cylindrical layer 240 and is configured to direct a pressurized gas from within the bridge layer 230 through the outer surface of the sleeve 210.

The channel(s) can generally have a variety of different sizes and/or shapes. For example, in one embodiment, the channel(s) 250 have a diameter of about 2 millimeters. Moreover, one or multiple channels 250 may generally be utilized. For instance, in one embodiment, eight channels 250 are evenly spaced apart around the circumference of the sleeve 210 near the leading end of the sleeve 210.

The sleeve 210 also includes a groove 251 that functions as an air distribution manifold for feeding a pressurized gas to the channel(s) 250. In the depicted embodiment, the groove 251 extends radially into the bridge layer 230 and is configured to extend circumferentially around the bridge layer 230 so that it can communicate with the channel(s) 250.

In addition, the sleeve 210 also includes a gas inlet bore 252 defined in the bridge layer 230 and configured to extend axially in the bridge layer 230. The gas inlet bore 252 is configured with a threaded wall 253 to receive a threaded pressurized gas fitting for the provision of pressurized gas from outside the sleeve 210.

Further, the sleeve 210 also includes at least one gas conduit 256 that extends axially through the bridge layer 230. In some embodiments, for example, two gas conduits 256 are disposed 1800 apart around the circumference of the bridge layer 230 to ensure that the sleeve 210 is rotationally balanced. Although only one of the gas conduits 256 may permit the passage of a pressurized gas from the gas inlet bore 252 to the channel(s) 250, provision can be made to permit both conduits 256 to carry a gas. The gas conduit(s) 256 may be formed from a variety of different materials, such as a metal (e.g., aluminum) or a rigid plastic. In addition, the gas conduit(s) 256 can generally vary in size. For example, in some embodiments, the gas conduit(s) 256 can have an inside diameter of from about 3/16 of an inch to about ¼ of an inch.

As shown, the gas conduit(s) 256 can also be connected into an axially extending fitting opening 266 defined in two spacer rings 244 and 245. An adhesive is desirably used to secure the ends of the conduit 256 in an airtight fashion in the fitting openings 266.

The spacer ring 244 includes an elbow conduit 267 that has an axial leg 268 parallel to and connected to the fitting opening 266. The elbow conduit 267 also has a radially extending leg 269 connected to the groove 251, which, as stated above, forms a gas distribution manifold. The elbow conduit 267 can have an inside diameter of from about 3/16 of an inch to about ¼ of an inch, which is typically smaller than the diameter of the conduits 256 and the groove 251. Moreover, the combined flow area of all of the channels 250 is typically smaller than the effective flow area of the groove 251, which helps ensure even flow distribution and pressure of the flowing gas to the channel(s) 250.

To help ensure that the desired rotational balance is achieved, the sleeve 210 can also include a groove 255 that is defined in the bridge layer 230 and configured to extend radially into the bridge layer 230 from the outer surface thereof and circumferentially around the entire sleeve 210. The groove 255 is configured to communicate with the gas inlet bore 252. As shown, the groove 255 is defined in the spacer ring 245 and communicates with the gas inlet bore 252 via the radial leg 269.

To operate this embodiment of the sleeve 210, a printing cylinder 213 is provided with a facility for dispensing pressurized air through its outer surface via air escape holes 225 is fitted with the sleeve 210. One end of the outer surface of the printing cylinder 213 is provided with a beveled surface and initially receives one end of the sleeve 210 thereon. Near that same end of the printing cylinder, the air escape holes 225 are provided. The spacer sleeve 210 is slid onto the outer surface of the printing cylinder 213 until the air escape holes 225 are covered by the sleeve 210. Then the pressurized air is supplied to the air escape holes in the printing cylinder 213, having the effect of expanding the inner surface of the core member 220 of the sleeve 210 sufficiently to easily slide the remaining length of the spacer sleeve onto the outer surface of the printing cylinder 213.

Once the entire sleeve 210 is positioned symmetrically onto printing cylinder 213, the pressurized air is discontinued. Whereupon, the inner surface of the core member 220 contracts to apply a tight fit about the outer surface of the printing cylinder 213. In this way, the sleeve 210 becomes torsionally rigidly mounted on the outer surface of the printing cylinder 213. In other words, no slippage exists between the outer surface of the printing cylinder 213 and the inner surface of the sleeve's core member 220.

A printing sleeve 215 carrying an attached printing plate 216 is then slid onto the end of the sleeve 210. The printing sleeve 215 is slid until it covers the channels 250 in the outer cylindrical layer 240. A pressurized gas fitting (not shown) is attached to the threaded wall 253 of the gas inlet bore 252. Pressurized air is then provided through the gas fitting into the gas inlet bore 252. The pressurized air travels through the conduit 256 and the elbow conduit 267 and fills the groove 251. The pressurized gas then escapes through the channels 250 and allows the inner surface of the printing sleeve 215 to be slid entirely onto outer surface 237 of the sleeve 210. Whereupon the pressurized air is discontinued, and the gas fitting is disconnected from the threaded wall 253 of the gas inlet bore 252.

Upon cessation of the pressurized air through the channels 250, the inner surface of the printing sleeve 215 contracts so as to grip the outer surface 237 of the sleeve 210 in a manner that results in the printing sleeve 215 becoming torsionally locked to the sleeve 210. After the printing job is completed, and a different sleeve is to be mounted on the spacer sleeve, the gas fitting can be reconnected to the gas inlet 252. Similarly, the sleeve 210 can be removed by reversing the process by which the sleeve was mounted onto the printing cylinder 213.

Printing sleeves formed in accordance with the present invention can provide a number of benefits to a user (i.e., converter). For example, by eliminating the compressible layer from the outer surface of the core layer, the printing sleeves of the present invention are believed to be more durable and maintain better TIR tolerances than conventional printing sleeves. In particular, a generally rigid, relatively expandable bridge layer can provide the printing sleeve with durable properties for extended use by a converter.

The present invention may be better understood with reference to the following examples.

EXAMPLE 1

The ability of a printing sleeve of the present invention to be placed on a printing cylinder was demonstrated. Initially, the core layer was formed using fiberglass. In particular, a flat woven fiberglass tape having a width of about one inch was passed through a bath of epoxy resin. Thereafter, the tape was wound around an undersized forming cylinder from a first end of the mandrel to the opposite second end of the cylinder, such as described in U.S. Pat. No. 5,819,657 to Rossini. In particular, the dipped fiberglass strands were repeatedly wound back and forth along the cylinder until enough windings were applied so as to form a core layer of fiberglass reinforced resin with a radial thickness of 0.060 inches. Thereafter, the cylinder and the fiberglass reinforced resin core still wound around the mandrel were placed in an hot air oven for several hours to polymerize the core into a fiberglass reinforced polymeric precursor tube. Then the sleeve and cylinder mandrel were removed from the oven and allowed to cool to ambient temperature. The cooled core layer was then ground to have a thickness between about 0.040 to about 0.045 inches. The surface of the core layer was cleaned with a solvent.

After forming the core layer, the bridge layer was then formed. In particular, ISA-PUR 2330 was obtained from H.B. Fuller AUSTRIA to apply to the core layer. The ISA-2330 was combined with a thixotrope and a hardening agent, which were also obtained from H.B. Fuller AUSTRIA, and extruded onto the core layer, which was positioned on a rotating cylinder. When applying the bridge layer, the extruder was moved in a lengthwise direction above the core layer. Specifically, the extruder was twice moved from one end of the cylinder to the other end while depositing the bridge layer material onto the core layer. The resulting bridge layer had a thickness of approximately 0.375 inches.

An outer layer was then applied to the outer surface of the unfinished bridge layer. In particular, ISA-PUR 2340 was obtained from H.B. Fuller AUSTRIA to apply to the bridge layer. The ISA-2340 was also combined with a thixotrope and a hardening agent, which were also obtained from H.B. Fuller AUSTRIA, and extruded onto a bridge layer disposed on the rotating cylinder. When applying the outer layer, the extruder was moved a lengthwise direction above the core layer. Specifically, the extruder was moved once from one end of the cylinder to the other end while depositing the outer layer material on the bridge layer. The resulting outer layer had a thickness of approximately 0.250 inches.

After forming the above layers, the entire sleeve was allowed to cure for about five (5) days at room temperature, or four (4) hours in a hot oven. Once cured, the sleeve was removed from the oven and ground to have a generally smooth outer surface with a TIR less than 0.0005. The sleeve was then cut to a finished length of 62 inches. The resulting sleeve had an outer layer (i.e., ISA-PUR 2340) with a final hardness of 75 Shore D and a bridge layer (i.e., ISA-PUR 2330) with a final hardness of 46 Shore D. Moreover, the resulting sleeve had a core layer with a thickness of 0.040 inches, a bridge layer with a thickness of 0.350 inches, and an outer layer with a thickness of 0.088 inches. The sleeve also had a finished diameter of 8.344 inches.

The ability of the finished sleeve to be placed onto the outer surface of a printing cylinder was then determined. In particular, a printing cylinder having a diameter of 7.389 inches and a facility for dispensing pressurized air through its outer surface was provided. Thereafter, an air pressure of 90 psi was then supplied to the holes in the printing cylinder. The entire length of the finished sleeve was positioned onto the outer surface of the printing cylinder with relative ease. In particular, the air pressure had the effect of sufficiently expanding the inner surface of the sleeve to enable it to easily slide onto the outer surface of the printing cylinder.

Once the entire sleeve was positioned onto the printing cylinder, the pressurized air was discontinued. Thus, the inner surface of the sleeve core contracted and became mounted on the outer surface of the printing cylinder.

The sleeve was then removed with essentially the same process by which the sleeve was mounted onto the printing cylinder.

EXAMPLE 2

The ability of a printing sleeve of the present invention to be placed on a printing cylinder was demonstrated. Initially, a core layer was formed as described in Example 1. After forming the core layer, the bridge layer was then formed. In particular, ISA-PUR 2330 was obtained from H.B. Fuller AUSTRIA to apply to the core layer. The ISA-2330 was combined with a thixotrope and a hardening agent, which were also obtained from H.B. Fuller AUSTRIA, and extruded onto the core layer, which was positioned on a rotating cylinder. When applying the bridge layer, the extruder was moved in a lengthwise direction above the core layer. Specifically, the extruder was moved three times from one end of the cylinder to the other end while depositing the bridge layer material onto the core layer. The resulting bridge layer had a thickness of approximately 0.875 inches.

An outer layer was then applied to the outer surface of the unfinished bridge layer. In particular, ISA-PUR 2340 was obtained from H.B. Fuller AUSTRIA to apply to the bridge layer. The ISA-2340 was also combined with a thixotrope and a hardening agent, which were also obtained from H.B. Fuller AUSTRIA, and extruded onto the bridge layer disposed on the rotating cylinder. When applying the outer layer, the extruder was moved a lengthwise direction above the core layer. Specifically, the extruder was moved once from one end of the cylinder to the other end while depositing the outer layer material on the bridge layer. The resulting outer layer had a thickness of approximately 0.300 bridge layer. The resulting outer layer had a thickness of approximately 0.300 inches.

After forming the above layers, the entire sleeve was allowed to cure for about five (5) days at room temperature, or four (4) days in a hot oven. Once cured, the sleeve was removed from the oven and ground to have a generally smooth outer surface with a TIR less than 0.0005. The sleeve was then cut to a finished length of 45 inches. The resulting sleeve had an outer layer (i.e., ISA-PUR 2340) with a final hardness of 78 Shore D and a bridge layer (i.e., ISA-PUR 2330) with a final hardness of 44 Shore D. Moreover, the resulting sleeve had a core layer with a thickness of 0.040 inches, a bridge layer with a thickness of 0.860 inches, and an outer layer with a thickness of 0.095 inches. The sleeve also had a finished diameter of 5.161 inches.

The ability of the finished sleeve to be placed onto the outer surface of a printing cylinder was then determined. In particular, a printing cylinder having a diameter of 3.172 inches and a facility for dispensing pressurized air through its outer surface was provided. Thereafter, an air pressure of 90 psi was then supplied to the holes in the printing cylinder. The entire length of the finished sleeve was positioned onto the outer surface of the printing cylinder with relative ease. In particular, the air pressure had the effect of sufficiently expanding the inner surface of the sleeve to enable it to easily slide onto the outer surface of the printing cylinder.

Once the entire sleeve was positioned onto the printing cylinder, the pressurized air was discontinued. Thus, the inner surface of the sleeve core contracted and became mounted on the outer surface of the printing cylinder.

The sleeve was then removed with essentially the same process by which the sleeve was mounted onto the printing cylinder.

Although various embodiments of the invention have been described using specific terms, devices, and methods, such description is for illustrative purposes only. The words used are words of description rather than of limitation. It is to be understood that changes and variations may be made by those of ordinary skill in the art without departing from the spirit or scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A printing sleeve that is capable of being air-mounted onto a rotogravure or flexographic printing cylinder comprising:

a core layer having a generally cylindrical shape, said core layer having an inner surface and an outer surface, said inner surface of said core layer defining a hollow internal region that forms an inner surface of the printing sleeve;

a bridge layer having a generally cylindrical shape, said bridge layer having an inner surface and an outer surface, said inner surface of said bridge layer being disposed against said outer surface of said core layer, said bridge layer comprising a relatively expandable polyurethane material having a Shore D hardness of from about 20 to about 85; and wherein said air-mountable printing sleeve has a thickness greater than about 0.250 inches.

2. A printing sleeve as defined in claim 1, wherein said printing sleeve is capable of expanding between about 0.0015 to about 0.0045 inches in a radial direction when supplied with air at a pressure between about 80 to about 90 pounds per square inches.

3. A printing sleeve as defined in claim 1, wherein said printing sleeve is capable of expanding between about 0.0025 to about 0.0035 inches in a radial direction when supplied with air at a pressure between about 80 to about 90 pounds per square inches.

4. A printing sleeve as defined in claim 1, wherein said core layer comprises fiberglass reinforced epoxy resin.

5. A printing sleeve as defined in claim 1, wherein said core layer has a thickness between about 0.020 to about 0.100 inches.

6. A printing sleeve as defined in claim 1, wherein said bridge layer has a Shore D hardness between about 45 to about 50.

7. A printing sleeve as defined in claim 1, wherein said bridge layer has a thickness between about 0.125 to about 1.5 inches.

8. A printing sleeve as defined in claim 1, wherein said bridge layer has a thickness between about 0.125 to about 1.0 inches.

9. A printing sleeve as defined in claim 1, further comprising at least one passageway that is configured to direct a pressurized gas through said bridge layer to the outer surface of said printing sleeve.

10. A printing sleeve as defined in claim 1, wherein the Total Indicated Runout (TIR) of the printing sleeve is less than about 0.001 inches.

11. A printing sleeve as defined in claim 1, wherein the Total Indicated Runout (TIR) of the printing sleeve is less than about 0.0005 inches.

12. A printing sleeve as defined in claim 1, further comprising at least one outer layer having a generally cylindrical shape, wherein said outer layer has an inner surface and an outer surface, said inner surface of said outer layer being disposed against said outer surface of said bridge layer.

13. A printing sleeve as defined in claim 12, wherein said outer layer comprises a polyurethane material.

14. A printing sleeve as defined in claim 12, wherein said outer layer comprises a rigid polyurethane foam material.

15. A printing sleeve as defined in claim 12, wherein said outer layer has a thickness between about 0.065 to about 0.250 inches.

16. A printing sleeve as defined in claim 12, wherein said outer layer has a thickness between about 0.075 to about 0.20 inches.

17. A printing sleeve as defined in claim 12, further comprising at least one passageway that is configured to direct a pressurized gas to the outer surface of said outer layer of said printing sleeve.

18. A printing sleeve that is capable of being air-mounted onto a rotogravure or flexographic printing cylinder comprising:

a core layer having a generally cylindrical shape, said core layer having an inner surface and an outer surface, said inner surface of said core layer defining a hollow internal region that forms an inner surface of the printing sleeve;

a bridge layer having a generally cylindrical shape, said bridge layer having an inner surface and an outer surface, said inner surface of said bridge layer being disposed against said outer surface of said core layer, said bridge layer comprises a polyurethane material having a Shore D hardness between about 45 to about 50; and wherein said air-mountable printing sleeve has a thickness greater than about 0.250 inches.

19. A printing sleeve as defined in claim 18, wherein said printing sleeve is capable of expanding between about 0.0015 to about 0.0045 inches in a radial direction when supplied with air at a pressure between about 80 to about 90 pounds per square inches.

20. A printing sleeve as defined in claim 18, wherein said printing sleeve is capable of expanding between about 0.0025 to about 0.0035 inches in a radial direction when supplied with air at a pressure between about 80 to about 90 pounds per square inches.

21. A printing sleeve as defined in claim 18, wherein said bridge layer has a thickness between about 0.125 to about 1.0 inches.

22. A printing sleeve as defined in claim 18, further comprising at least one outer layer having a generally cylindrical shape, wherein said outer layer has an inner surface and an outer surface, said inner surface of said outer layer being disposed against said outer surface of said bridge layer.

23. A method of air-mounting a printing sleeve onto a printing cylinder comprising:

a) providing a first printing sleeve having a thickness greater than about 0.250 inches, said first printing sleeve including:

i) a core layer having a generally cylindrical shape, said core layer having an inner surface and an outer surface, said inner surface of said core layer defining a hollow internal region; and ii) a bridge layer having a generally cylindrical shape, said bridge layer having an inner surface and an outer surface, said inner surface of said bridge layer being disposed against said outer surface of said core layer, said bridge layer comprising a relatively expandable polyurethane material having a Shore D hardness of from about 20 to about 85;

b) expanding said first printing sleeve in a radial direction with a pressurized gas; and c) mounting said expanded first printing sleeve onto a printing cylinder having an outer surface such that said inner surface of said core layer faces said outer surface of said printing cylinder.

24. A method as defined in claim 23, wherein said first printing sleeve expands between about 0.0015 to about 0.0045 inches when said pressurized gas is at a pressure between about 80 to about 90 pounds per square inches.

25. A method as defined in claim 23, wherein said first printing sleeve expands between about 0.0025 to about 0.0035 inches when said pressurized gas is at a pressure between about 80 to about 90 pounds per square inches.

26. A method as defined in claim 23, wherein said bridge layer comprises a polyurethane material having a Shore D hardness between about 45 to about 50.

27. A method as defined in claim 23, wherein said bridge layer has a thickness between about 0.125 to about 1.0 inches.

28. A method as defined in claim 23, wherein the Total Indicated Runout (TIR) of said printing sleeve is less than about 0.001 inches.

29. A method as defined in claim 23, wherein the Total Indicated Runout (TIR) of the printing sleeve is less than about 0.0005 inches.

30. A method as defined in claim 23, wherein said first printing sleeve further comprises at least one outer layer having a generally cylindrical shape, wherein said outer layer has an inner surface and an outer surface, said inner surface of said outer layer being disposed against said outer surface of said bridge layer.

31. A method as defined in claim 30, wherein said outer layer comprises a rigid polyurethane foam material.

32. A method as defined in claim 30, wherein said outer layer has a thickness between about 0.075 to about 0.20 inches.

33. A method as defined in claim 30, wherein said first printing sleeve defines at least one passageway that is configured to direct a pressurized gas to said outer surface of said outer layer of said first printing sleeve.

34. A method as defined in claim 33, further comprising air-mounting a second printing sleeve onto said outer surface of said outer layer of said first printing sleeve.

* * * * *

UNITED STATES PATENT AND TRADEMARK OFFICE

CERTIFICATE OF CORRECTION

PATENT NO. : 6,691,614 B2 
APPLICATION NO. : 09/883086
DATED : February 17, 2004
INVENTOR(S) : Michael Bell and Felice Rossini It is certified that error appears in the above-identified patent and that said Letters Patent is hereby corrected as shown below:

On the Title Page Item -56-
The following references need to be added to the References Cited section of the patent:

| | | |
|---|---|---|
| 2,365,980 | 12/1944 | Thomas |
| 3,015,268 | 1/1962 | Garrett |
| 3,043,211 | 7/1962 | Appenzeller |
| 3,146,709 | 9/1964 | Bass et al. |
| 3,475,803 | 11/1969 | Hill |
| 3,673,025 | 6/1972 | Fukuyama et al. |
| 3,880,831 | 4/1975 | Senju et al. |
| 3,959,574 | 5/1976 | Seanor et al. |
| 3,978,254 | 8/1976 | Hoexter et al. |
| 4,003,311 | 1/1977 | Bardin |
| 4,020,762 | 5/1977 | Peterson |
| 4,030,415 | 6/1977 | Fellows |
| 4,044,678 | 8/1977 | Rasmussen |
| 4,089,265 | 5/1978 | White et al. |
| 4,119,032 | 10/1978 | Hollis |
| 4,144,812 | 3/1979 | Julian |
| 4,144,813 | 3/1979 | Julian |
| 4,197,798 | 4/1980 | Bardin |
| 4,248,959 | 2/1981 | Jeffers et al. |
| 4,264,712 | 4/1981 | Kress |
| 4,269,930 | 5/1981 | Kress |
| 4,272,608 | 6/1981 | Proskow |
| 4,296,172 | 10/1981 | Hill |
| 4,301,727 | 11/1981 | Bardin |
| 4,332,873 | 6/1982 | Hughes et al. |
| 4,345,022 | 8/1982 | Kress |
| 4,381,709 | 5/1983 | Katz |
| 4,436,032 | 3/1984 | van Ouwerkerk |
| 4,446,222 | 5/1984 | Kress |
| 4,496,434 | 1/1985 | Morssinkhof |
| 4,503,769 | 3/1985 | Anderson |
| 4,554,040 | 11/1985 | van der Velden |
| 4,583,460 | 4/1986 | Maslin et al. |
| 4,624,184 | 11/1986 | Katz et al. |
| 4,641,411 | 2/1987 | Meulen |
| 4,651,643 | 3/1987 | Katz et al. |
| 4,685,393 | 8/1987 | Saueressig |

UNITED STATES PATENT AND TRADEMARK OFFICE

CERTIFICATE OF CORRECTION

PATENT NO. : 6,691,614 B2
APPLICATION NO. : 09/883086
DATED : February 17, 2004
INVENTOR(S) : Michael Bell and Felice Rossini It is certified that error appears in the above-identified patent and that said Letters Patent is hereby corrected as shown below:

On the Title Page Item -56-
The following references need to be added to the References Cited section of the patent (cont'd):

| | | |
|---|---|---|
| 4,758,500 | 7/1988 | Schober et al. |
| 4,794,858 | 1/1989 | Katz |
| 4,817,698 | 4/1989 | Rossini et al. |
| 4,864,926 | 4/1989 | Saueressig |
| 4,903,597 | 2/1990 | Hoage et al. |
| 4,934,266 | 6/1990 | Fantoni |
| 5,015,553 | 5/1991 | Grandmont et al. |
| 5,206,992 | 5/1993 | Carlson et al. |
| 5,260,166 | 11/1993 | Nazzaro et al. |
| 5,316,798 | 5/1994 | Tittgemeyer |
| 5,468,568 | 11/1995 | Kuhn et al. |
| 5,544,584 | 8/1996 | Thompson et al. |
| 5,688,633 | 11/1997 | Leach |
| 5,706,731 | 1/1998 | Francille et al. |
| 5,711,222 | 1/1998 | Taylor et al. |
| 5,735,206 | 4/1998 | Rossini |
| 5,752,444 | 5/1998 | Lorig |
| 5,782,181 | 7/1998 | Rossini |
| 5,784,961 | 7/1998 | Lorig et al. |
| 5,797,322 | 8/1998 | Lorig et al. |
| 5,819,657 | 10/1998 | Rossini |
| 5,916,403 | 6/1999 | Cushner et al. |
| 5,925,500 | 7/1999 | Yang et al. |
| 5,976,765 | 11/1999 | Kumpfmiller et al. |
| 5,983,799 | 11/1999 | Lane, III et al. |

UNITED STATES PATENT AND TRADEMARK OFFICE

CERTIFICATE OF CORRECTION

PATENT NO. : 6,691,614 B2
APPLICATION NO. : 09/883086
DATED : February 17, 2004
INVENTOR(S) : Michael Bell and Felice Rossini It is certified that error appears in the above-identified patent and that said Letters Patent is hereby corrected as shown below:

On the Title Page Item -56-
The following references need to be added to the References Cited section of the patent (cont'd):

| | | |
|---|---|---|
| DE | 1229548 | 12/1966 |
| DE | 3525045A | |
| DE | G8532300 | 2/1986 |
| EP | 384104B1 | 9/1994 |
| EP | 741330A1 | 11/1996 |
| EP | 0278017 | 8/1988 (Abstract) |
| IT | 188238 | 1/1986 |
| JP | 57107845 | 7/1982 |
| UK | 151232 | 12/1980 |

AirFlexoSleeves

Signed and Sealed this

Nineteenth Day of June, 2007

JON W. DUDAS
*Director of the United States Patent and Trademark Office*